US005941026A

United States Patent [19]

Eisenreich et al.

[11] Patent Number: 5,941,026

[45] Date of Patent: Aug. 24, 1999

[54] SLATWALL DISPLAY SYSTEM

[75] Inventors: Richard G. Eisenreich, Shorewood; Carl B. Landgren, Fox Point; Michael P. Sieren, Milwaukee, all of Wis.

[73] Assignee: storeWall LLC, Milwaukee, Wis.

[21] Appl. No.: 09/009,112

[22] Filed: Jan. 20, 1998

[51] Int. Cl.[6] ..... E04B 2/74

[52] U.S. Cl. ..... 52/36.5; 52/36.4; 52/12; 52/23; 248/243; 248/235; 211/87.01; 211/94.01; 211/103

[58] Field of Search ..... 52/36.4, 36.5, 52/211, 12, 23; 248/243, 235; 211/87.01, 94.01, 103

[56] References Cited

U.S. PATENT DOCUMENTS

| | | | |
|---|---|---|---|
| 4,211,379 | 7/1980 | Morgan et al. . | |
| 4,420,087 | 12/1983 | Johns | 211/189 |
| 4,603,068 | 7/1986 | Hunter . | |
| 4,607,753 | 8/1986 | Radek . | |
| 4,944,416 | 7/1990 | Petersen et al. . | |
| 4,961,295 | 10/1990 | Kosch, Sr. et al. . | |
| 5,101,986 | 4/1992 | Holztrager | 211/13 |
| 5,228,579 | 7/1993 | Kaufman . | |
| 5,409,120 | 4/1995 | Miller et al. . | |
| 5,412,912 | 5/1995 | Alves . | |
| 5,484,067 | 1/1996 | Sothman . | |
| 5,791,093 | 8/1998 | Diamond | 52/36.5 |
| 5,819,490 | 10/1998 | Current | 52/588.1 |

*Primary Examiner*—Carl D. Friedman
*Assistant Examiner*—Nkeisha J. Maddox
*Attorney, Agent, or Firm*—Andrus, Sceales, Starke & Sawall

[57] ABSTRACT

A slatwall display system is provided for retaining at least one article holder thereon. The system includes a mounting member having a series of spaced projecting ears formed with upwardly projecting surfaces defining slat panel supports. The system further includes a multiplicity of slat panels interconnected together, one on top of another, at spaced slatwall panel joints to define a slat panel assembly. Each of the slat panels has a plurality of coplanar forward wall portions, a plurality of coplanar rearward wall portions spaced rearwardly of the forward wall portions, and a plurality of central wall portions joining the forward wall and rearward wall portions. The rearward wall portions are separated from each other by projecting ear recesses formed between the forward wall and rearward wall portions. The projecting ear recesses include a series of spaced, inverted, generally V-shaped notches receiving the upwardly projecting surfaces of the projecting ears.

33 Claims, 6 Drawing Sheets

30
36
32
30
10
8
14
5
16
30
7
16
34
18
7
40
64
8
18b
64
20
22
42
24
5
64
24a
24b
28
24c
64
64
64
64
38

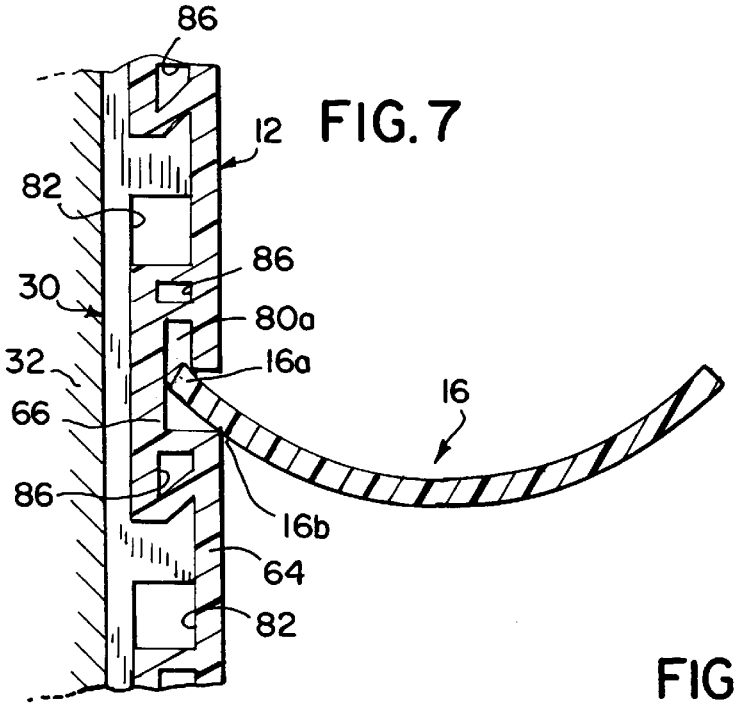
FIG. 7
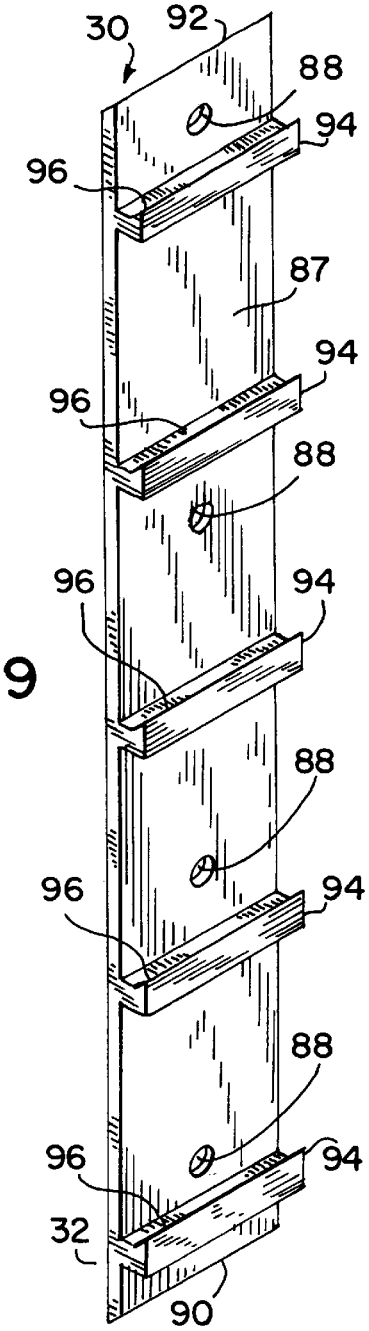
FIG. 9
FIG. 8
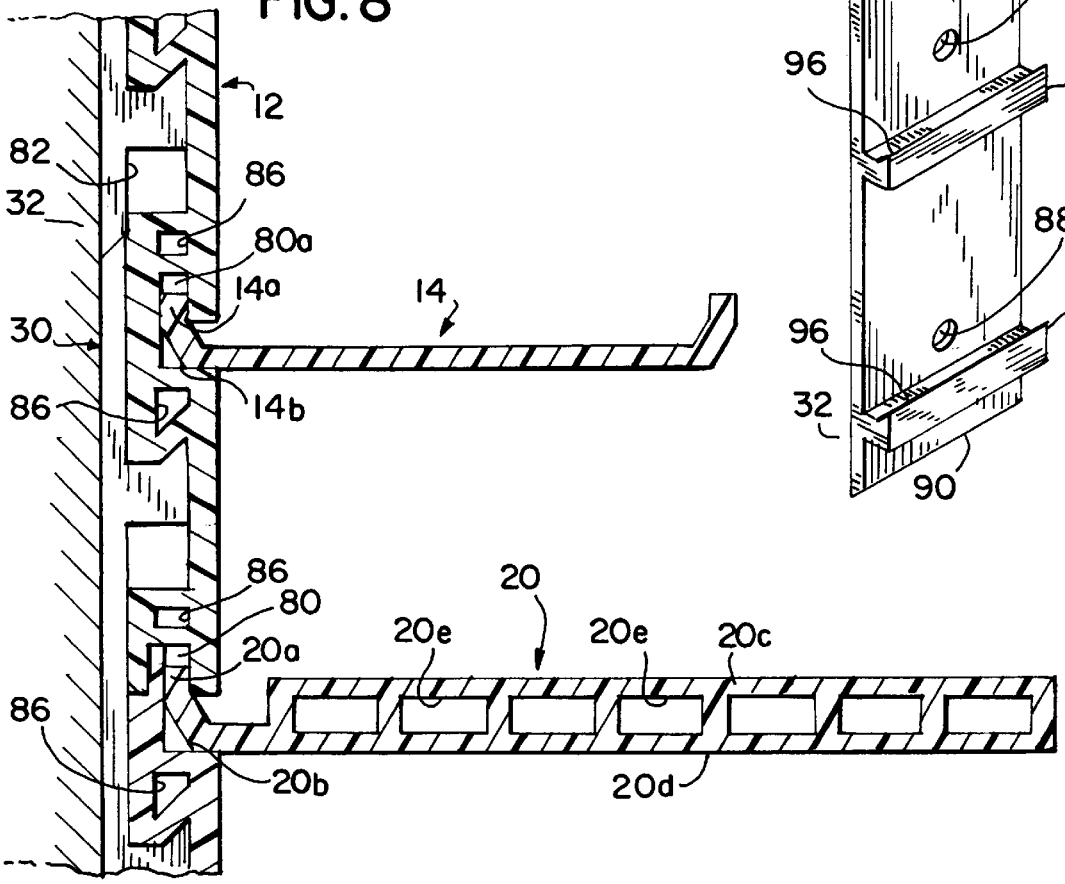

FIG. 18
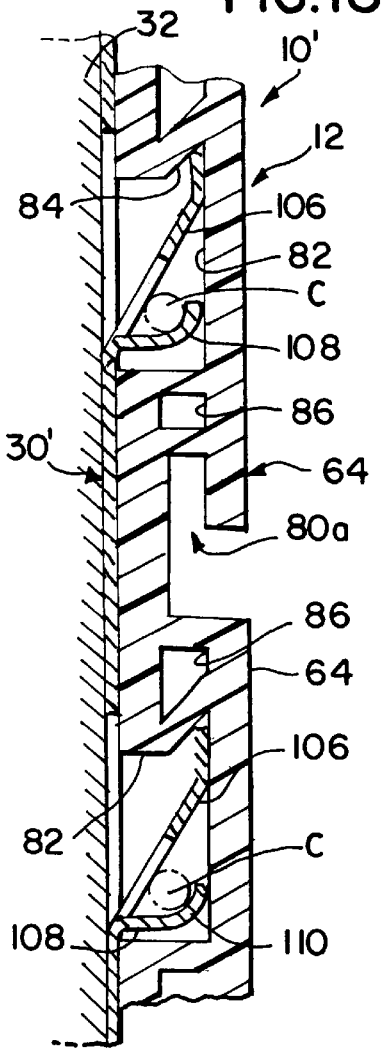
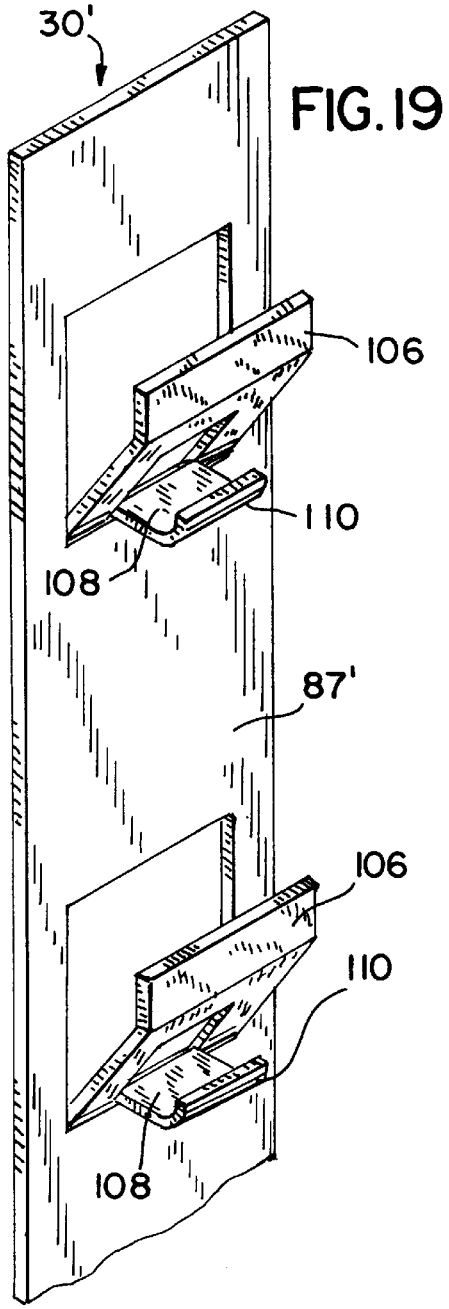
FIG. 19
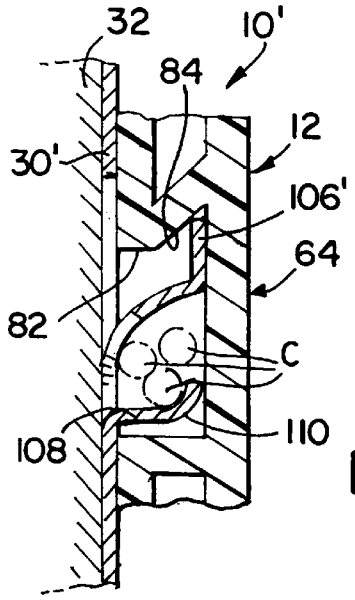
FIG. 20

SLATWALL DISPLAY SYSTEM

FIELD OF THE INVENTION

The present invention relates generally to display arrangements and, more particularly, pertains to slat panels adapted to interlock with one another to form a modular slatwall panel assembly which is secured on a wall-mounted vertical support and is utilized to support and display various articles therefrom.

BACKGROUND OF THE INVENTION

Slatwalls have a front surface formed by horizontally elongated front members separated by horizontally elongated grooves. The grooves receive article holders, such as shelves, trays, brackets, and the like which, in turn, display and support a variety of articles. Slatwalls have been used extensively for wall displays in merchandising and retail applications because of the versatility they offer as far as placement of the article holders thereon. More recently, slatwalls have been found to be extremely desirable in commercial applications such as in the office and workplace, as well as in consumer applications in the home and school.

Typically, slatwalls are formed with horizontally elongated slatwall sections or slat panels that are interlocked with similar upper and lower slat panels to form a slat panel assembly. Generally, the upper and lower ends of each slat panel have edge structure which cooperates with those of vertically adjacent sections to secure the slat panels together at slatwall panel joints. One or more slat panels are supported directly on a vertical wall or a mounting member fixed to the wall to define a slatwall display system. It is necessary that the cooperating engagement between vertically adjacent slat panels be designed such that the finished assembly is sturdy. In addition, the spacing between the front members of the slat panels should be consistent to present an aesthetically pleasing appearance of the slatwall. Further, the grooves in the slat panels should be formed to promote stable engagement between the slat panel assembly and the article holders that are supported thereon by the forming walls of the grooves. Moreover, the slat panel assembly and the mounting member should be provided with mating structure to securely mount the slat panel assembly to a vertical wall.

While some attempts have been made to produce slat panels from metal and plastic, the most widely used materials for the manufacturing of slatwall display are fiberboard (MDF, HDF), particle board (HDP), plywood and other wood-like sheet materials. Uniqueness or customization is supplied through surface applications including paint, high and low pressure laminates, transfer foils, wood veneers, mirrors, etc. Generally, wood-like panels measuring four feet in width, eight feet in length and ¾ inch in thickness are employed. Parallel grooves are routed or milled across the width of the panels and are spaced on equal centers over the surface. The routed grooves or slots form a female receptacle for accommodating article holders having connecting structures so that they can be supported in a cantilevered fashion. The slots are generally L-shaped or T-shaped in cross-section and are uniformly sized to accept an array of article holders and accessories such as shelves, brackets, baskets, trays, hooks, racks and lights.

Despite its widespread use and ability to offer customized service treatment, these wood-like panels have several limitations. The panels are heavy and fragile, and do not cut, fabricate or finish well. Those familiar with the products are aware that the constitution of fiberboard, particle board and other wooden panels is extremely brittle and rigid. As a result of its makeup, the grooves cut into the panel must often be reinforced by inserts. Coupled with its large size and heavy weight, the panel is awkward to ship, handle and install. The panel also lacks strength and when damaged, is unsightly and difficult to repair. A further drawback encountered in the use of such moisture permeable panels is the effect of warpage which can occur when the panels are subjected to varying environmental changes, are processed with certain surface coatings or are sanitized using liquid cleaners.

Notwithstanding the slatwall arrangements described above, it remains desirable to provide a slatwall display system which retains the positive structural and functional characteristics of prior art slatwall design and simultaneously eliminates the negative factors. It is desirable to provide a slatwall display system which is lightweight yet extremely durable, priced competitively and usable in a variety of various environments. It is also desirable to provide a slatwall display system having a mounting member and a plurality of interconnected, juxtaposed slat panels capable of sustaining a high degree of vertical loading. Further, it is desirable to provide a slatwall display system which is easier and less expensive to ship, install and handle. Likewise, it is desirable to provide a slatwall panel having forward facing structure for supporting various article holders and rearward facing structure for securely mounting the panel on a wall support.

BRIEF SUMMARY OF THE INVENTION

The present invention advantageously resides in an improved and highly versatile display system of the slatwall-type which offers superior quality, durability, strength, flexibility, handling and maintenance.

It is a general object of the present invention to provide a plurality of slat panels which may be interlocked together to form a display which is attractive in appearance.

It is another object of the present invention to provide a slat panel display which is easily, yet securely mounted to a vertical wall support.

It is an additional object of the present invention to provide a slatwall display system which is strong enough to support a variety of article holders therefrom in a cantilevered fashion.

It is also an object of the present invention to provide an expandable slatwall display system formed of extruded polyvinylchloride (PVC) which is much less fragile than fiberboard, is relatively lightweight and is impervious to moisture.

Still another further object of the present invention is to provide a slatwall display system having slat panel joints which make installation easier and create article holder recesses without the need for reinforcing inserts.

Another object of the present invention is to provide a slatwall display system having a potential in a wide range of markets associated with commercial, industrial, institutional, office, workplace, residential and trade show applications.

In one aspect of the invention, a slatwall display system is provided for retaining at least one article holder thereon. The system includes a mounting member having a series of spaced projecting ears formed with upwardly projecting surfaces defining slat panel supports. A multiplicity of slat panels is interconnected together, one on top of the other, at spaced slatwall panel joints to define a slat panel assembly.

Each of the slat panels has a plurality of forward wall portions, a plurality of rearward wall portions spaced rearwardly of the forward wall portions, and a plurality of central wall portions joining the forward wall and rearward wall portions. The rearward wall portions are separated from each other by projecting ear recesses formed between the forward wall and the rearward wall portions. The projecting ear recesses include a series of spaced, inverted, generally V-shaped notches receiving the upwardly projecting surfaces of the projecting ears to support the slat panels on the mounting member.

Each slatwall joined is preferably located between an adjacent pair of the inverted, V-shaped notches. The forward wall portions are separated from each other by forwardly opening article holder recesses formed between the forward wall and the rearward wall portions for receiving at least one article holder therein. Each slat panel includes an upper edge and a lower edge, one of the edges being provided with a groove and another of the edges being provided with a tongue dimensioned and oriented to be accommodated in the groove of another slat panel to retain the slat panels together. The uppermost edges cooperate together at the slatwall panel joint to define another article holder recess. The groove is formed by the rearward wall portion and the forward wall portion, and the tongue is engageable substantially against the rearward wall portion only. In a preferred embodiment, the upper edge on the uppermost slat panel of the slat panel assembly is secured to a vertically extending wall to which the mounting member is attached. The upper edge of the uppermost slat panel is provided with the groove and is secured to the vertically extending wall by a decorative trim member having a tongue which is received in the groove, a vertical backbone which is bonded to the vertically extending wall, and an upwardly and outwardly extending brace which is engageable with a ceiling lying perpendicular to the vertically extending wall. In an alternative form of the invention, the upper edge of the uppermost slat panel is secured to the vertically extending wall by a fastener.

In the preferred embodiment, the projecting ear on the mounting member includes an upper portion which is substantially triangular in cross-section. The projecting ear on the mounting member includes a lower portion which is substantially square or substantially triangular in cross-section. In the alternative form of the invention, the projecting ear on the mounting member includes an upper portion which extends upwardly and outwardly, then vertically. The projecting ear on the mounting member has a lower portion which is formed from the upper portion and extends outwardly then upwardly. The upper and lower portions define a raceway for holding at least one utility conductor, while each projecting ear is engaged in its respective inverted V-shaped notch. Each article holder recess is generally L-shaped or reversely J-shaped in cross-section. The rearward wall portion is provided with a keeper which is biased forwardly or rearwardly into one of the article holder recesses. In a preferred embodiment, the rearward wall portion of the slat panel is bonded to the mounting member. In an alternative form of the invention, each alternating projecting ear recess defines a raceway for holding at least one utility conductor. In the preferred embodiment, each projecting ear and projecting ear recess defines a raceway for holding at least one utility conductor. The article holder takes the form of a shelf, a bracket, a hanger, or the like. In the preferred embodiment, the mounting members and the slatwall panels are constructed of extruded PVC material, while in the alternative form the mounting member may be constructed of metal. Both the forward wall portions and the rearward wall portions are coplanar. In the preferred embodiment, each of the projecting ears completely fills its inverted, V-shaped notch, while in the alternative form of the invention each of the projecting ears partially fills its inverted, V-shaped notch.

In another aspect of the invention, a slatwall panel is provided for use in a slat panel assembly. A body has a plurality of coplanar forward wall portions, a plurality of coplanar rearward wall portions spaced rearwardly of the forward wall portions, a plurality of central wall portions joining the forward wall and rearward wall portions, an upper edge and a lower edge. The upper edge includes a vertically extending tongue offset from one of the rearward wall portions, and a forwardly projecting portion terminating in the forward wall portion. The lower edge includes a groove cut into one of the central wall portions between one of the rearward wall portions and one of the forward wall portions, the upper edge tongue being received in the lower edge groove of an adjacent body and engageable against its rearward wall portion only to form a slat panel joint. The unoccupied walls of the groove, a bottom of the forward wall portion on the adjacent body, the tongue and the forwardly projecting portion define a first forwardly opening article holder recess for accommodating an article holder therein. Adjacent forward wall portions are separated by a plurality of second forwardly-opening article holder recesses lying between the upper edge and the lower edge on each body. Adjacent rearward wall portions are separated by projecting ear recesses formed between the forward wall and rearward wall portions. The projecting ear recesses include a series of spaced, inverted, generally V-shaped notches receiving mating projecting ears formed on a rigidly anchored mounting member, the inverted, V-shaped notch being spaced from the slat panel joint. The bodies are formed with a plurality of material-saving voids, each void being located above one of the inverted, V-shaped notches. Each of the article holder recesses is L-shaped, while each of the grooves has an inverted U-shape.

In yet another aspect of the invention, a slatwall display system has a mounting member provided with projecting structure for mounting a series of slat panels together at slat panel joints, one atop the other. The improvement resides in the slat panels being supported on the projecting structure of the mounting member at locations spaced from the slat panel joints.

Various other features, objects and advantages of the invention will be made apparent from the following description taken together with the drawings.

BRIEF DESCRIPTION OF THE SEVERAL VIEWS OF THE DRAWING

The drawings illustrate the best mode presently contemplated of carrying out the invention.

In the drawings:

FIG. 5 is a fragmentary, cross-sectional view taken on line 5—5 of FIG. 1;

FIG. 7 is a fragmentary, cross-sectional view taken on line 7—7 of FIG. 1;

FIG. 8 is a fragmentary, cross-sectional view taken on line 8—8 of FIG. 1;

FIG. 9 is a perspective view of the mounting member used in the display system of FIG. 1;

FIG. 18 this a fragmentary, cross-sectional view of a display system employing a mounting member having a first alternative projecting ear;

FIG. 19 is a fragmentary, perspective view of the mounting member shown in FIG. 18; and FIG. 20 is a view similar to FIG. 18, but showing a mounting member provided with a second alternative projecting ear.

DETAILED DESCRIPTION OF THE INVENTION

Figure 1:
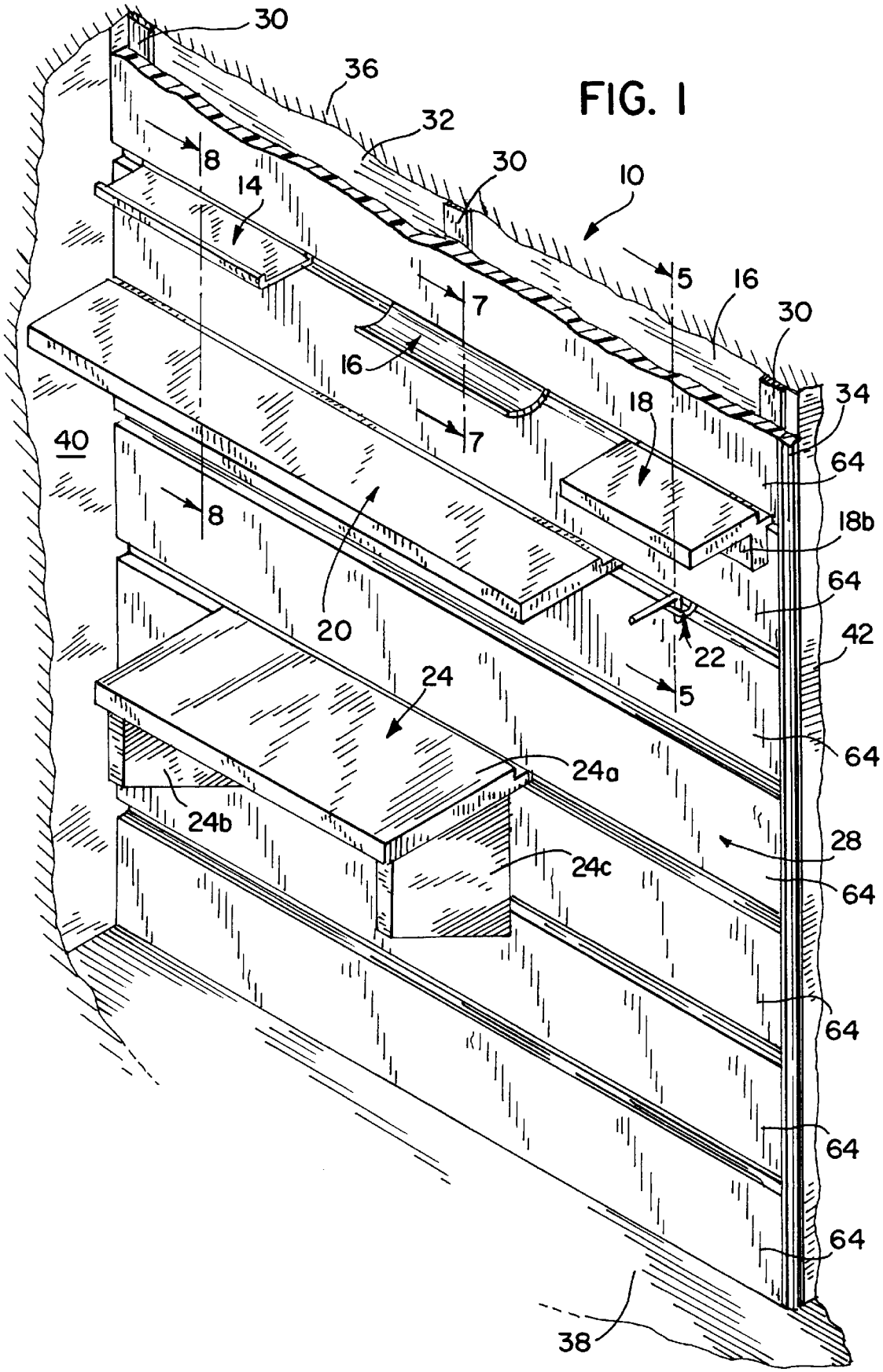
FIG. 1 is a front perspective view of a slatwall display system for supporting several article holders in accordance with the present invention, the upper portion of the display system being broken away to permit underlying components to be seen.

Referring now to FIG. 1, the reference numeral 10 generally identifies the slatwall display system constructed in accordance with the principles of the invention for supporting and displaying various types of article holders 14, 16, 18, 20, 22, and 24 from a front side thereof. With additional reference to FIGS. 5 and 6, system 10 is comprised of a series of horizontally disposed, generally rectangular slat panels 12 juxtaposed and interconnected together, one atop the other, at slatwall panel joints 26 (FIG. 5) to form a slat panel assembly 28. The slat panel assembly 28 is supported on a set of vertically extending mounting members 30 rigidly anchored to a vertical wall 32. Both slat panels 12 and mounting members 30 are substantially rigid elements and are preferably formed of extruded polyvinylchloride (PVC). An elongated, U-shaped finished cap 34 is provided to conceal the exposed side edges of the slat panel assembly 28. In the preferred embodiment of FIG. 1, it can be seen that the slat panel assembly 28 extends lengthwise from a ceiling 36 which is perpendicular to the wall 32 downwardly and completely to a floor 38. The slat panel assembly 28 also extends widthwise from one adjoining vertical wall 40 to another adjoining vertical wall 42. It should be appreciated from the outset of this description that the slat panel assembly 28 could also be mounted on a free-standing vertical wall which could carry the slat panels on one or both sides thereof as desired by the user. Likewise, it should be understood that while the article holders 14–24 are preferably shown as shelves and a hanger, the slatwall panel assembly 28 is equally capable of supporting other article holders such as baskets, trays, brackets, lights, etc.

Figure 2:
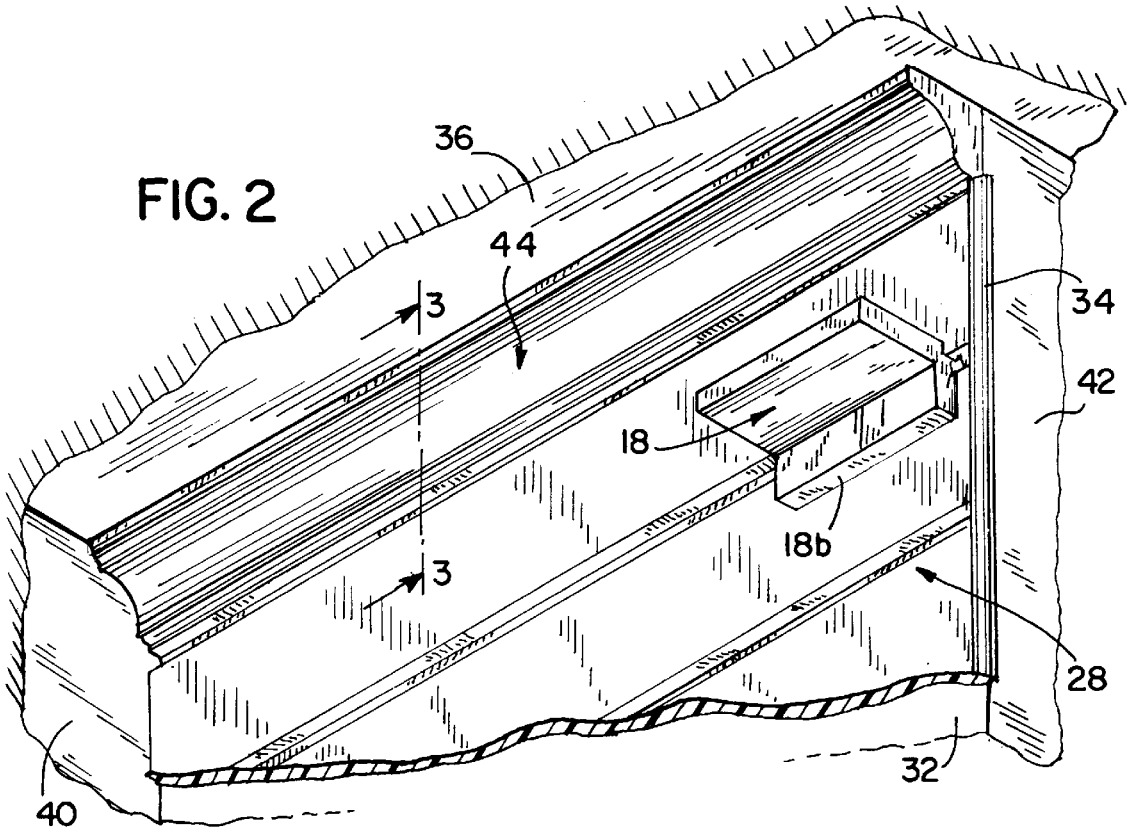
FIG. 2 is a fragmentary, perspective view of the top portion of the slatwall display system showing a decorative trim member interposed between a ceiling and a wall on which the display system is mounted.
Figure 3:
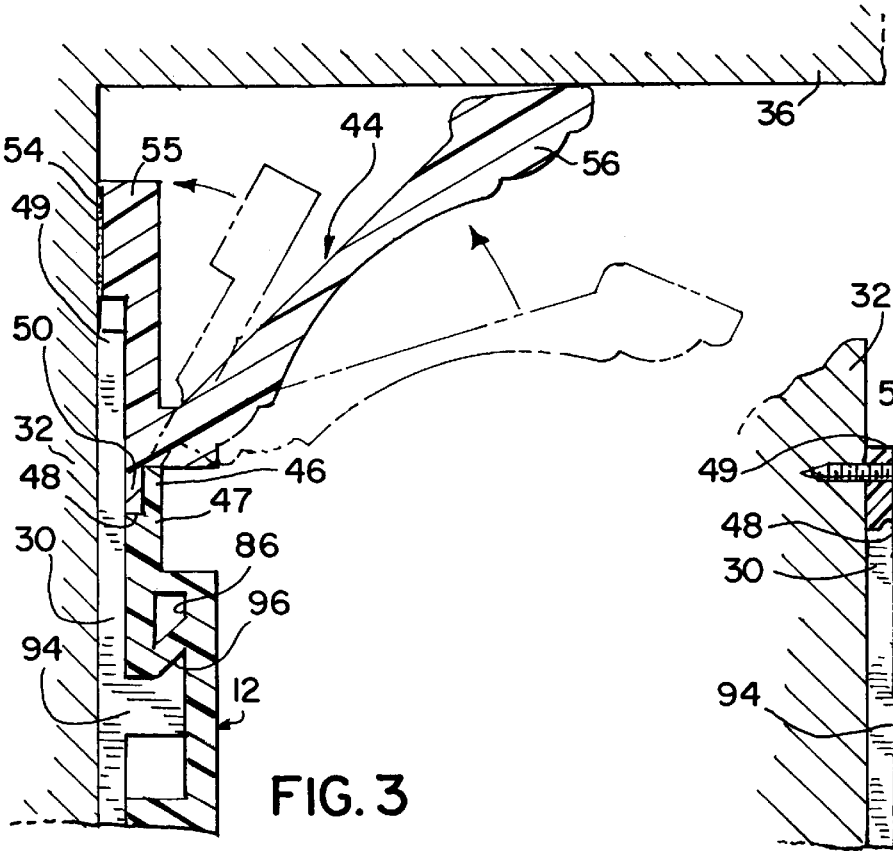
FIG. 3 is a fragmentary, cross-sectional view taken on line 3—3 of FIG. 2 showing the manner in which the decorative trim member is installed to secure the upper portion of the display system to the wall.

As seen in FIGS. 2 and 3, a decorative trim member 44 is interposed between the wall 32 and the ceiling 36 to fix the uppermost slat panel 12 and the uppermost mounting member 30 to the wall 32 without conventional fasteners. A vertically extending tongue 46 on the upper edge 47 of the uppermost slat panel 12 and the uppermost edge 47 of the uppermost mounting member 30 together form a channel 48, and are secured to the wall 32 by a trim member tongue 50 which depends downwardly and is received in the channel 48. The trim member 44 further includes a vertical backbone 52 which is bonded such as by an adhesive 54 to the wall 32, and an upwardly and extending brace 56 which is engageable with the ceiling 36. The phantom lines of FIG. 3 illustrate the initial disposition of the trim member 44. Once the tongue 50 has been located in the channel 48 between the front side of the mounting member 30 and the rear side of tongue 46, trim member 44 is pivoted upwardly and inwardly in the direction of the arrow shown in FIG. 3 until the backbone 52 is bonded to the wall 32 and the brace 56 contacts the bottom of the ceiling 36.

Figure 4:
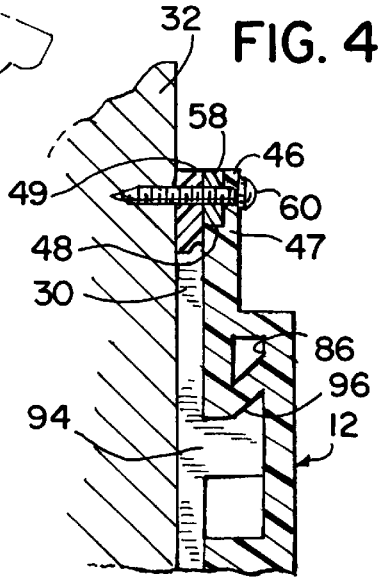
FIG. 4 is a fragmentary, cross-sectional view similar to FIG. 3, but showing an alternative arrangement for securing the display system to the wall.

In the event a more conventional fastening of the upper portion of the slatwall 12 and the mounting member 30 is desired, the upper edges of these two components are aligned, a rubber seal 58 or the like is disposed in the channel 48 and the screw 60 is threaded into a hole formed in tongue 46, seal 58, mounting member 30 and wall 32, as depicted in FIG. 4.

Figure 6:
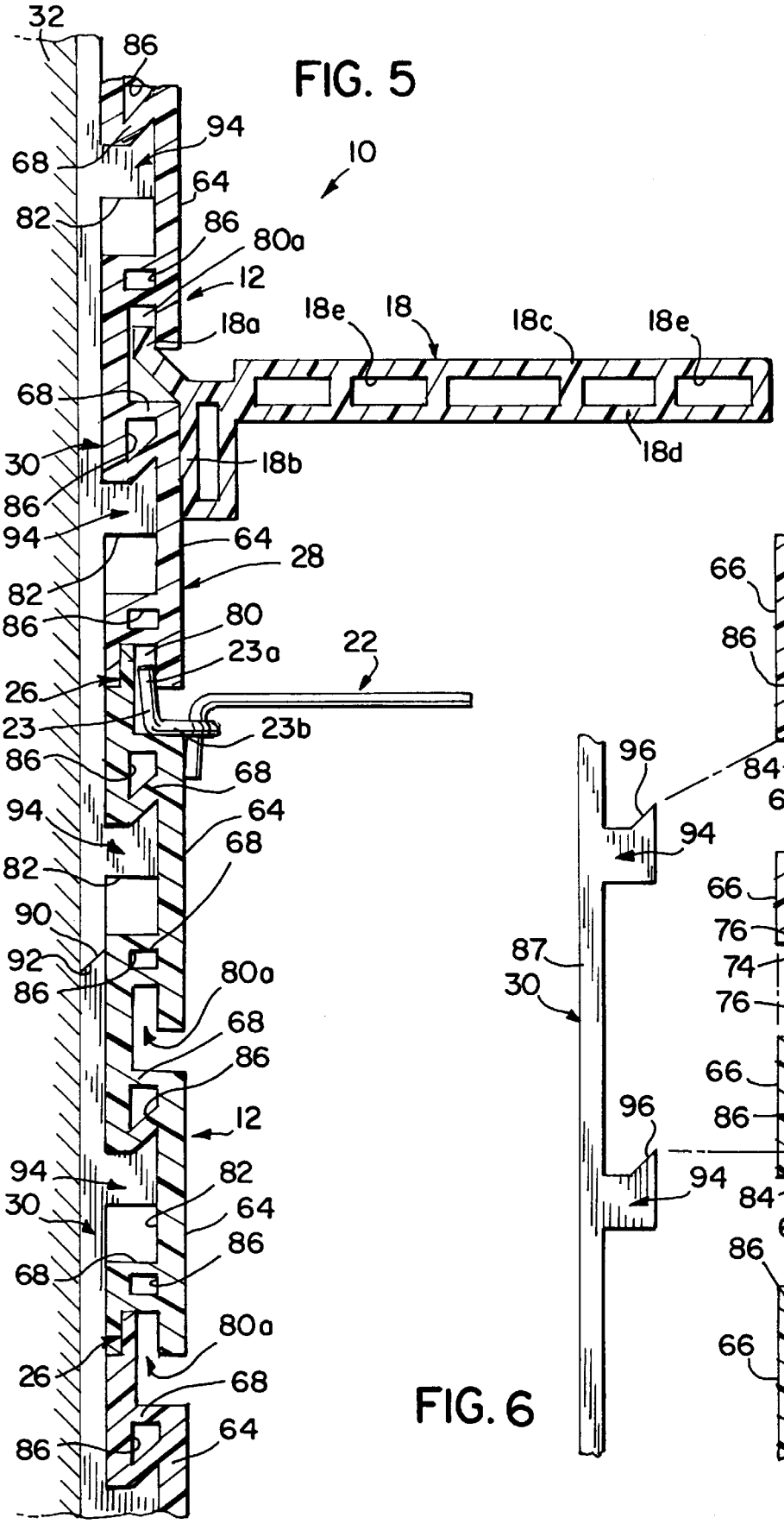
FIG. 6 is a fragmentary, exploded view of several components of the display system seen in FIG. 5.

Turning now to FIGS. 5 and 6, each slat panel is comprised of a body 62 having a plurality of coplanar forward wall portions 64, a plurality of coplanar rearward wall portions 66 spaced rearwardly of the forward wall portions 64, and a plurality of central wall portions 68 joining the forward wall and rearward wall portion 64, 66. Each slat panel 12 also has a lower edge 70 in addition to the upper edge 47 introduced above. The tongue 46 on upper edge 47 is offset from the rearward wall portion 66 and extends downwardly to intersect with a forwardly projecting portion 72 terminating at the forward wall portion 64. The lower edge 70 is provided with an inverted, U-shaped groove 74 cut into the central wall portion 68 between the lowermost forward wall portion 64 and the lowermost rearward wall portion 66. Upper edge tongue 46 is dimensioned and oriented to be accommodated in groove 74 of an adjoining slat panel lower edge 70 to retain the slat panel set 12 together in slatwall panel joint 26 (FIG. 5). However, it should be appreciated that tongue 46 is only engageable with rearward wall portion 66 along its inner face 76 (FIG. 6), and with central portion 68 along its uppermost end 78.

When adjacent slat panels 12 are held together at joint 26, a first, forwardly opening, L-shaped article holder recess 80 (FIG. 5) is formed by the unoccupied walls of groove 74, a bottom of the forward wall portion 64 on the adjacent body 62, the tongue 46 and the forwardly projecting portion 72.

The offset tongue 46 cooperates with the forward wall portion 64 to form a substantially moisture proof seal which prevents any moisture introduced into recess 80, such as by environmental conditions, cleaning fluid or the like, from reaching mounting member 30. It should also be noted that the L-shaped recess 80 has a vertical leg portion which opens through the forward wall portion 64. This design enables any moisture extant in the recess 80 to be pulled down by gravity and led away from the slat panel 12. The forward wall portions 64 are separated from each other by additional forwardly opening, L-shaped article holding recesses 80*a* formed between the forward wall and rearward wall portion 64, 66. The rearward wall portion 66 are separated from each other by projecting ear recesses 82 formed between the forward wall and rearward wall portions 64, 66. The projecting ear recesses 82 include a series of spaced, inverted, generally V-shaped notches 84 which cooperate with mating structure on the mounting members 30 as will be described below. The central wall portions 68 are molded with material saving voids 86 located above and below the L-shaped article holder recesses 80, 80*a*.

With additional attention to FIG. 9, each mounting member 30 has a planar base 87 formed with a series of aligned holes 88 through which suitable fasteners (not shown) are passed to rigidly anchor each mounting member 30 to the wall 32. As also seen in FIG. 5, each mounting member 30 has cooperating upper and lower beveled edges 90, 92 which permit two or more mounting members 30 to be mounted one atop the other. Spaced equidistantly along the length of the mounting member 30 is a series of forwardly projecting ears 94 which completely fill the notches 84. The ears 94 are formed with upwardly projecting surfaces 96 which are matingly received in the inverted V-shaped notches 94 on slat panel assembly 28 and thereby function as slat panel supports.

FIGS. 1, 5, 7 and 8 demonstrate how variously-shaped article holders 14, 16, 18, 20 and 22 are frictionally retained in L-shaped article holder recesses 80 and 80*a*. In FIG. 5, a flat shelf 18 has an upper mounting segment 18a which bears against the rear face of forward wall portion 64, and a depending lower mounting segment 18*b* which bears directly against the forward wall portion 64. Shelf 18 is reinforced by two layers 18*c* and 18*d* of material and includes a series of material saving voids 18*e*. Hanger 22 includes a pair of projecting fingers 23 having an upper mounting segment 23*a* which bears against the rear face of forward wall portion 64, and a lower mounting segment 23*b* which rests directly on forward wall portion 64.

In FIG. 7, a curved shelf 16 has an upper mounting segment 16*a* disposed between forward wall and rearward wall portions 64, 66 respectfully, and a lower mounting segment 16*b* resting on forward wall portion 64. In FIG. 8, a substantially flat shelf 14 has identical structure on forward and rearward ends. Upper and lower mounting segments 14*a*, 14*b* are mounted as in FIG. 7. Another substantially flat shelf 20 has upper and lower mounting segments 20*a*, 20*b* similar to shelf 14 described above. Shelf 20 is reinforced with two layers 20*c* and 20*d* of material and includes a series of material saving voids 20*e*.

In FIG. 1, shelf 24 is comprised of a substantially rectangular top member 24 and a pair of substantially trapezoidal side braces 24*b*, 24*c*. Member 24*a* and braces 24*b* and 24*c* have similar mounting segments as described above in connection with shelves 14, 16, 18 and 20.

Figure 10:
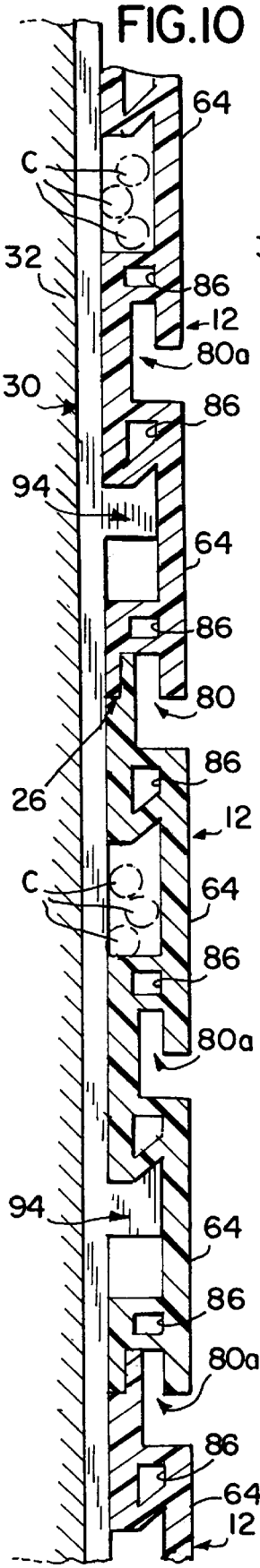
FIG. 10 is a fragmentary, cross-sectional view of the display system forming raceways for holding a plurality of conductors.

FIG. 10 sets forth the slatwall display system 10 in which projecting ears 94 are spaced such that each alternating projecting ear recess 82 defines a raceway for holding at least one and preferably several utility conductors C such as phone or electric lines.

Figure 11:
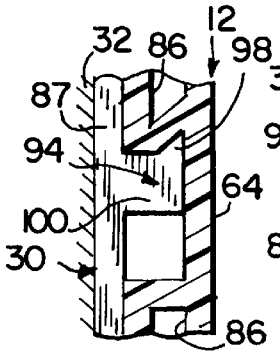
FIG. 11 is a fragmentary, cross-sectional view of the display system shown in FIGS. 3—9 illustrating the shape of a projecting ear on the mounting member.
Figure 12:
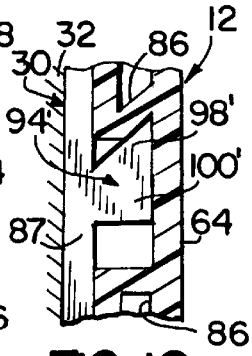
FIG. 12 is a view similar to FIG. 11, but showing the shape of a first alternative projecting ear.
Figure 13:
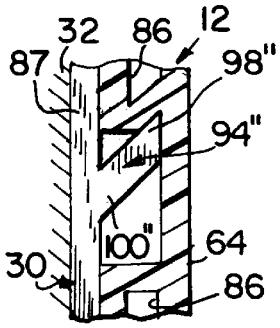
FIG. 13 is a view similar to FIG. 11, but showing the shape of a second alternative projecting ear.

In the preferred embodiment of FIG. 11, the projecting ear 94 has an upper portion 98 which is substantially triangular in cross section, and a lower portion 100 which is substantially square in cross section. FIG. 12 shows a first alternative projecting ear 94' having different proportions than the projecting ear 94 but still exhibiting an upper triangular portion 98' and a lower square portion 100'. FIG. 13 shows the shape of a second alternative projecting ear 94" having a substantially triangular upper portion 98" and is substantially triangular lower portion 100".

Figure 14:
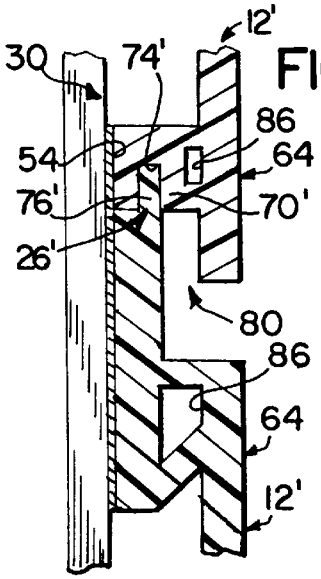
FIG. 14 is an enlarged, fragmentary, cross-sectional view of a slatwall panel joint formed by upper and lower portions of slat panels as shown in FIG. 5, the upper and lower portions of slatwall being fixed to the mounting member by a bonding agent.

FIG. 14 shows an enlarged, fragmentary, cross sectional view of a slatwall panel joint 26' in which the slat panel lower edge 70' is designed with a narrower groove 74' which is substantially the thickness of the tongue 76'. In addition, the rearward wall portions 66 on respective upper and lower edges 47, 70 are secured to wall 32 with adhesive 54. This design not only strengthens the attachment of adjoining slat panels 12' in the vicinity of the joint 26', but further enhances the sealing capability provided by the tongue 76' and groove 74'.

Figure 15:
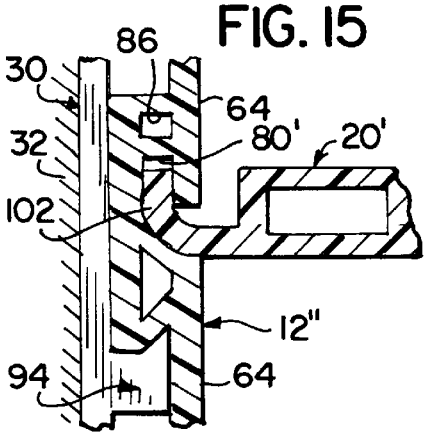
FIG. 15 is a fragmentary, cross-sectional view of the display system shown in FIG. 5, illustrating an additional article holder retained in a radiused, reversely J-shaped article holder recess.

FIG. 15 portrays a slat panel 12" in which the wall of the article holder recess 80' is radiused along one side to form a reversely J-shaped opening for frictionally receiving the mating curved end 102 of a horizontally disposed shelf 20'.

Figure 16:
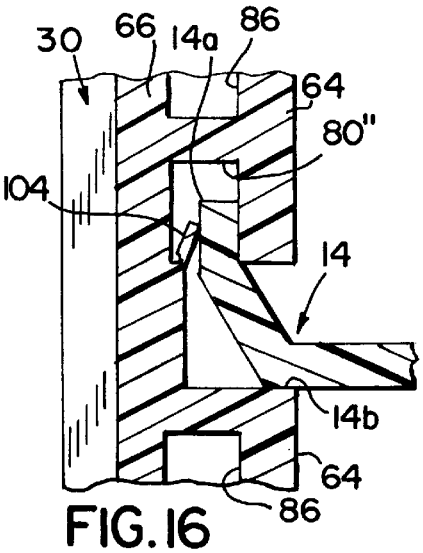
FIG. 16 is an enlarged, fragmentary cross-sectional view of the display system showing an alternative L-shaped article holder recess provided with a rear keeper.
Figure 17:
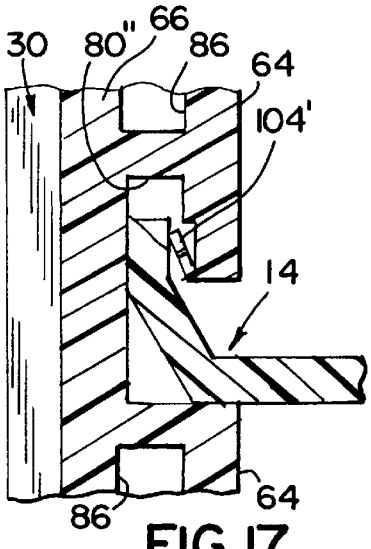
FIG. 17 is a view similar to FIG. 16, but showing a L-shaped article holder recess provided with a front keeper.

FIG. 16 discloses the L-shaped article holder recess 80" in which rearward wall portion 66 is integrally formed with a keeper 104 biased forwardly so that the attachment end of an article holder has a upper end 14*a* sandwiched between the keeper 104 and the forward wall portion 64 and the lower end 14*b* resting upon forward wall portion 64. FIG. 17 is similar to FIG. 16, but has a rearwardly biased keeper 104' integrally formed on forward wall portion 64.

FIG. 18 depicts a slatwall display system 10' employing an alternative mounting member 30' (FIG. 19) having an upper portion 106 which extends outwardly and upwardly then vertically to partially fill the inverted V-shaped notch 84. Mounting member 30' also includes a lower portion 108 which is formed from the upper portion 106 and terminates in an upwardly turned finger 110 for cradling at least one utility conductor C passed through the projecting ear recess 82. FIG. 20 resembles a slatwall display system 10' except for the curved segment on upper portion 106' which allows a multiple number of conductors C to be supported by finger 110.

In use, one or more mounting members 30 are rigidly fixed to the vertical wall 32 as shown in FIG. 1 using fasteners or adhesive (not shown). Starting from the bottom of the mounting members 30, a slat panel 12 is supported on mounting member 30, by the cooperation of projecting ears 94, 94', 94" in inverted V-shaped notches 84. Next, another slat panel 12 is positioned on top of the bottommost slat panel 12 so that the slat panel upper edge tongue 76 or 76' cooperates with slat panel lower edge groove 74 or 74' as depicted in FIGS. 5 and 14, respectively. This process is repeated until the desired height of the display system 10, 10' is reached on the wall 32. At this point, the slat panel assembly 28 and mounting member 30, are fastened to the wall 32 such as by fasteners 60 as shown in FIG. 4. Alternatively, if the interlock slat panels 12 run substantially the entire height of the wall 32, the decorative trim member 44 is installed between the wall and the ceiling 36 as shown in FIG. 2 and described above. One or more finished caps 34 may be installed on any exposed side edges of the slatwall panel assembly 28. Once the display system is in place, article holders 14–22 are easily and positively secured by placing the mounting end of each article holder 14–22 in the article holder recess 80 or 80*a* with each article holder tipped slightly upwardly and then pivoted downwardly to wedge the mounting end into frictional engagement with the walls of the recess 80 or 80*a*. The installation procedure for alternative mounting member 30' is similar as for mounting member 30.

It should be appreciated that the present invention provides a slatwall display system in which the V-shaped notches on the slatwall panel assembly cooperate with the projecting ears to form an extremely effective anchor for supporting and displaying a myriad of article holders therefrom. It should also be appreciated that the slat panel display system permits the use of mounting members having variously-shaped projecting ears. In addition, the slatwall display system creates slatwall panel joints which are substantially sealed against moisture and the like. The slat panels and the mounting members defining the slatwall display system are lightweight and easily handled and installed, yet are extremely strong and durable.

While the invention has been described with reference to a preferred embodiment, those skilled in the art will appreciate that certain substitutions, alterations, and omissions may be made without departing from the spirit thereof. Accordingly, the foregoing description is meant to be exemplary only, and should not be deemed limitative on the scope of the invention as set in the following claims.

We claim:

1. A slatwall display system for retaining at least one article holder thereon, the system comprising:

at least one mounting member having a projecting ear formed with an upwardly projecting surface;

a multiplicity of slat panels interconnected together, one on top of another at spaced slatwall panel joints to define a slat panel assembly, each of the slat panels having a plurality of forward wall portions, a plurality of rearward wall portions spaced rearwardly of the forward wall portions, and a plurality of central wall portions joining the forward wall and rearward wall portions, the rearward wall portions being separated from each other by projecting ear recesses formed between the forward wall and rearward wall portions, the projecting ear recesses including a series of spaced, inverted, generally V-shaped notches receiving the upwardly projecting surface of the projecting ear to retain the slat panels on the mounting member.

2. The slatwall display system of claim 1, wherein each slatwall joint panel is located between an adjacent pair of the inverted, V-shaped notches.

3. The slatwall display system of claim 1 wherein the forward wall portions are separated from each other by forwardly opening article holder recesses formed between the forward wall and rearward wall portions for receiving at least one article holder therein.

4. The slatwall display system of claim 1, wherein each slat panel includes an upper edge and a lower edge, one of the edges being provided with a groove and another of the edges being provided with a tongue dimensioned and oriented to be accommodated in the groove of another slat panel to retain the slat panels together, the upper and lower edges cooperating together at a slatwall panel joint to define another article holder recess.

5. The slatwall display system of claim 4, wherein the groove is formed by the rearward wall portion and the forward wall portion, and the tongue is engageable substantially against the rearward wall portion only.

6. The slatwall display system of claim 4, wherein the upper edge on the uppermost slat panel in the slat panel assembly and an upper edge of the uppermost mounting member are secured to a vertically extending wall to which the mounting member is attached.

7. The slatwall display system of claim 4, wherein the upper edge of the uppermost slat panel and an upper edge of the uppermost mounting member are secured to a vertically extending wall by a fastener.

8. The slatwall display system of claim 6, wherein the upper edge of the uppermost slat panel and the upper edge of the uppermost mounting member form a groove and are secured to the vertically extending wall by a decorative trim member having a tongue which is received in the groove, a vertical backbone which is bonded to the vertically extending wall, and an upwardly and outwardly extending brace which is engageable with a ceiling lying perpendicular to the vertically extending wall.

9. The slatwall display system of claim 1, wherein the projecting ear on the mounting member includes an upper portion which is substantially triangular in cross section.

10. The slatwall display system of claim 1, wherein the projecting ear on the mounting member includes a lower portion which is substantially square in cross section.

11. The slatwall display system of claim 1, wherein the projecting ear on the mounting member includes a lower portion which is substantially triangular in cross section.

12. The slatwall display system of claim 1, wherein the projecting ear on the mounting member includes an upper portion which extends outwardly and upwardly, than vertically.

13. The slatwall display system of claim 12, wherein the projecting ear on the mounting member has a lower portion which is formed from the upper portion and extends outwardly, then upwardly.

14. The slatwall display system of claim 13, wherein the upper and lower portions define a raceway for holding at least one utility conductor while each projecting ear is engaged in its respective inverted V-shaped notch.

15. The slatwall display system of claim 3, wherein each article holder recess is generally L-shaped in cross section.

16. The slatwall display system of claim 15, wherein the rearward wall portion is provided with a keeper biased forwardly into one of the article holder recesses.

17. The slatwall display system of claim 15, wherein the forward wall portion is provided with a keeper biased rearwardly into one of the article holder recesses.

18. The slatwall display system of claim 3, wherein the article holder recess is generally reversely J-shaped in cross section.

19. The slatwall display system of claim 1, wherein the rearward wall portion of the slat panel is bonded to the mounting member.

20. The slatwall display system of claim 1, wherein each alternating projecting ear recess defines a raceway for holding at least one utility conductor.

21. The slatwall display system of claim 1, wherein each projecting ear and projecting ear recess define a raceway for holding at least one utility conductor.

22. The slatwall display system of claim 1, wherein the article holder is selected from the group consisting of shelves, brackets, and rods.

23. The slatwall display system of claim 1, wherein the mounting member and the slatwall panels are constructed of extruded PVC material.

24. The slatwall display system of claim 1, wherein the mounting member is constructed of metal.

25. The slatwall display system of claim 1, wherein the forward wall portions are coplanar.

26. The slatwall display system of claim 1, wherein the rearward wall portions are coplanar.

27. The slatwall display system of claim 1, wherein each of the projecting ears completely fills its inverted, V-shaped notch.

28. The slatwall display system of claim 1, wherein each of the projecting ears partially fills its inverted, V-shaped notch.

29. A slatwall panel for use in a slat panel assembly comprising:

a body having a plurality of coplanar forward wall portions, a plurality of coplanar rearward wall portions spaced rearwardly of the forward wall portions, a plurality of central wall portions joining the forward wall and rearward wall portions, an upper edge and a lower edge, the upper edge including a vertically extending tongue offset from one of the rearward wall portions, and a forwardly projecting portion terminating at the forward wall portion, the lower edge including a groove cut into one of the central wall portions between one of the rearward wall portions and one of the forward wall portions, the upper edge tongue being received in the lower edge groove of an adjacent body and engageable against its rearward wall portion and central wall portion only to form a slat panel joint, the groove having occupied walls defined by the engagement of the tongue along the rearward wall portion and a portion of the central wall portion and unoccupied walls defined by a further portion of the central wall portion and the forward wall portion, the unoccupied walls of the groove, a bottom of the forward wall portion on the adjacent body, the tongue and the forwardly projecting portion defining a first forwardly opening article holder recess for accommodating and article holder therein, adjacent forward wall portions being separated by a plurality of second forwardly opening article holder recesses lying between the upper edge and the lower edge on each body, and adjacent rearward wall portions being separated by projecting ear recesses formed between the forward wall and rearward wall portions, the projecting ear recesses including a series of spaced, inverted, generally V-shapes notches receiving at least one mating projecting ear formed on a rigidly anchored mounting member, the inverted V-shaped notches being spaced from the slat panel joint.

30. The slatwall panel of claim 29, wherein the body is formed with a plurality of material-saving voids, each void being located above one of the inverted, V-shaped notches.

31. The slatwall panel of claim 29, wherein each of the article holder recesses is L-shaped.

32. The slat panel of claim 29, wherein each of the grooves has an inverted U-shape.

33. In a slatwall display system having a mounting member provided with projecting structure for mounting a series of slat panels together at slat panel joints, one atop another, the improvement wherein:

the projecting structure on the mounting member is defined by a projecting ear formed with an upwardly projecting surface, the slat panels are formed with projecting recesses including a series of spaced invented V-shaped notches for receiving the ear, whereby the slat panels are supported on the projecting of the mounting member at locations spaced from the slat panel joints.

* * * * *